US006007299A

United States Patent [19]

Uematsu

[11] Patent Number: 6,007,299

[45] Date of Patent: Dec. 28, 1999

[54] RECOVERY TYPE STEAM-COOLED GAS TURBINE

[75] Inventor: Kazuo Uematsu, Takasago, Japan

[73] Assignee: Mitsubishi Heavy Industries, Ltd., Tokyo, Japan

[21] Appl. No.: 09/145,497

[22] Filed: Sep. 2, 1998

[30] Foreign Application Priority Data

Sep. 8, 1997 [JP] Japan ..... 9-242693

[51] Int. Cl.[6] ..... B63H 1/28

[52] U.S. Cl. ..... 416/96 R; 415/114; 415/116

[58] Field of Search ..... 416/95, 96 R, 416/97 R; 415/114, 115, 116, 117

[56] References Cited

U.S. PATENT DOCUMENTS

| | | | |
|---|---|---|---|
| 5,593,274 | 1/1997 | Carreno et al. | 415/115 |
| 5,695,319 | 12/1997 | Matsumoto et al. | 416/95 |
| 5,795,130 | 8/1998 | Suenaga et al. | 416/95 |

FOREIGN PATENT DOCUMENTS

| | | |
|---|---|---|
| 8-277725 | 10/1996 | Japan . |
| 9-144501 | 6/1997 | Japan . |
| 9-195702 | 7/1997 | Japan . |

*Primary Examiner*—Edward K. Look
*Assistant Examiner*—Ninh Nguyen
*Attorney, Agent, or Firm*—Wenderoth, Lind & Ponack, L.L.P.

[57] ABSTRACT

In a recovery type steam-cooled gas turbine, a steam passage leading to a moving blade is provided on a central side of a rotor for reducing leakage of the steam. Cooling steam 70 of a low temperature and high pressure is led into moving blades 1, 2 through supply side steam passages 12, 13 and steam passages 15, 16. After being used for cooling, it flows into a cavity 22 through steam passages 16, 17 to be recovered as recovery steam 71 of a high temperature and low pressure at a rotor end 20 through recovery side steam passages 19, 21. The cooling steam 70 of low temperature and high pressure passes on an inner side of the recovery steam 71 in the rotor, hence there are fewer places from where the high pressure steam leaks outside as compared with the prior art, in which the high pressure steam is supplied from the outer side in the rotor, and the leakage amount of steam is reduced.

4 Claims, 3 Drawing Sheets

RECOVERY TYPE STEAM-COOLED GAS TURBINE

BACKGROUND OF THE INVENTION

1. Field of the Invention

The present invention relates to a recovery type steam-cooled gas turbine in which supply steam for cooling is prevented from leaking.

2. Description of the Prior Art

FIG. 3 is a cross sectional view of a gas turbine which employs a representative steam-cooled system in the prior art. In FIG. 3, numeral 50 designates a compressor and numeral 51 designates a gas turbine. In the gas turbine 51, there are provided moving blades 21, 22, 23 on a periphery of a rotor 30. A high temperature combustion gas is led into a combustion gas passage 52 to flow therethrough to rotate the moving blades 21, 22, 23 between stationary blades 43, 44, 45 on a stationary side and to thereby rotate the rotor 30.

In a rotor disc 31, there are provided steam passages 33, 32, which connect to each other and pass through the rotor disc 31 in an axial direction thereof. The steam passages 33, 32 are provided in plural pieces along a circumferential direction of the rotor 30. Cooling steam 80 is led into the steam passage 33 via a steam inlet 35 of a shaft 34 to flow through the steam passage 32 and to enter a cavity 36. It then enters the moving blade 22 of the second stage via a supply side passage 37 for cooling of the blade and, after having cooled the blade, the steam flows into a cavity 39 via a recovery side passage 38. On the other hand, the steam flowing in the steam passage 32 enters a supply side passage 41 via a cavity 40 to flow therefrom into the moving blade 21 of the first stage for cooling the blade and, after having cooled the blade, the steam flows into the cavity 39 via a recovery side passage 42 to be joined with the recovery steam which has come out of the moving blade 22 of the second stage. The steam, so joined, flows out into a cavity 60 to flow through a central portion of the rotor 30 and to be recovered in the shaft 34 portion. Also, a portion of the steam in the steam passage 32 flows through a cavity 61 to be supplied into the compressor 50 for cooling thereof.

As many combined cycle power plants are now being constructed with a need for a high temperature and high efficiency, a gas turbine using a steam-cooled system as mentioned above is being eagerly studied to be employed in place of an air-cooled system as a leading cooling system of the gas turbine. Especially in the combined cycle power plant, a portion of the steam generated at a steam turbine is extracted to be led into the gas turbine for cooling thereof. The steam, used for cooling and being temperature-elevated, is recovered to be further returned to the steam turbine side. Hence an effective use of heat is carried out so as to contribute to a higher efficiency of the power plant. Great attention is being paid thereto recently.

In the gas turbine using the representative steam-cooled system in the prior art as mentioned above, the steam extracted from the steam turbine side is led into the moving blade for cooling thereof via the plurality of the steam passages provided in the periphery of the rotor and via the disc. The steam which has been used for cooling which is temperature-elevated is led into the central portion of the rotor via the cavity to be recovered through the rotor central portion, and then the steam is returned to the steam turbine side to be made use of effectively.

In the above-mentioned prior art steam-cooled system, however, because a low temperature high pressure steam is supplied through the rotor periphery, there are many places from where the steam, while being supplied, leaks to the outside low pressure side through joint portions etc. Hence it is necessary to provide a lot of seal portions. Thus, it has been a large problem in the steam-cooled system as to how the supply steam on the high pressure side is prevented from leaking to the low pressure side.

SUMMARY OF THE INVENTION

It is therefore an object of the present invention to provide a gas turbine that employs a steam-cooled system constructed such that a supply passage of steam on a high pressure side, that is, a supply side, is disposed on an inner side of a low pressure side reversely from the prior art so that there are fewer places from where the steam leaks to the low pressure side, whereby the recovery efficiency of the steam is enhanced.

In order to attain the object, the present invention provides the following:

(1) A recovery type steam-cooled gas turbine has a cooling steam led into a moving blade interior for cooling thereof through a supply side steam passage which passes through a rotor interior in a rotor axial direction from a rotor end. The steam, after being used for the cooling, is recovered through a recovery side steam passage which passes through the rotor interior in the rotor axial direction. The supply side steam passage is provided on an inner side of the recovery side steam passage.

(2) A recovery type steam-cooled gas turbine as mentioned above, wherein the supply side steam passage is provided in a rotor central portion.

In (1) above, the cooling steam of a low temperature and high pressure is supplied from the rotor end into the supply side steam passage in the rotor to be led into the moving blades for cooling thereof. The steam used for cooling which is temperature-elevated passes through the recovery side steam passage to be recovered at the rotor end to be returned to the steam turbine side for effective use thereof. The supply side steam passage, into which the supply steam of high pressure is supplied, passes on the inner side of the recovery side steam passage. Hence there are fewer places from where the steam leaks to the outside as compared with the prior art, in which the high pressure steam is supplied on the outer side. The leakage amount of steam is reduced by that degree, and the reliability of the recovery type steam-cooled gas turbine is enhanced.

In (2) above, the supply side steam passage is provided in the rotor central portion so that the passage of the high pressure steam comes is further on the inner side and there are even fewer places of leakage of the steam which flows to the moving blades and the leakage amount of steam can be reduced further.

DESCRIPTION OF THE PREFERRED EMBODIMENTS

Figure 1:
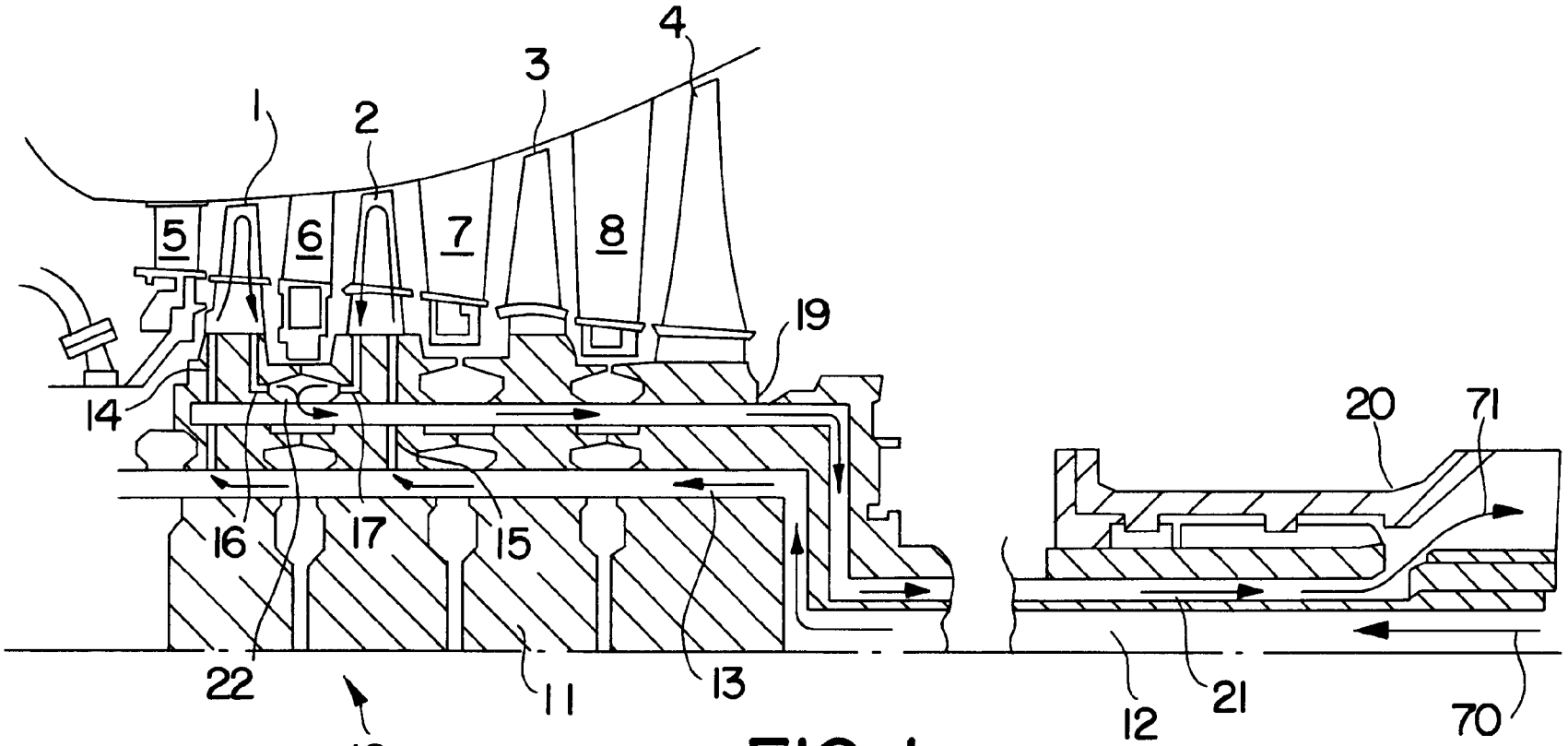
FIG. 1 is a cross sectional view of a recovery type steam-cooled gas turbine of a first embodiment according to the present invention.

Herebelow description will be made concretely on embodiments according to the present invention with reference to the figures. FIG. 1 is a cross sectional view of a recovery type steam-cooled gas turbine of a first embodiment according to the present invention. In FIG. 1, numerals 1 to 4 designate moving blades which are provided on a periphery of a rotor 10. Numerals 5 to 8 designate stationary blades on a stationary side, which are provided alternately with the moving blades 1 to 4. Numeral 11 designates a rotor disc, in which a supply side steam passage 13 is provided in an axial direction of the rotor 10. The supply side steam passage 13 is provided in plural pieces along a circumferential direction of the rotor 10, although not shown in the figure, for passing the steam therethrough. Numerals 14, 15 designate steam passages which connect respectively to the supply side steam passage 13 so that the steam is supplied into the moving blades 1, 2 therethrough.

Numerals 16, 17 also designate steam passages through which the steam used for the cooling of the moving blades 1, 2 flows out to be led into a cavity 22. Numeral 19 designates a recovery side steam passage, which passes through on an outer side of the supply side steam passage 13 in the axial direction of the rotor 10 and is provided in plural pieces (not shown). The recovery side steam passage 19 connects to the cavity 22 and the steam used for the cooling flows through this recovery side steam passage 19 to be recovered.

Numeral 20 designates a rotor end, in which a recovery side steam passage 21, elongated from the recovery side steam passage 19 on the rotor disc 11 side, is provided passing through in the axial direction of the rotor 10. Also, a supply side steam passage 12, elongated from the supply side steam passage 13 on the rotor disc 11 side, is provided on a central side of the rotor end 20.

In the gas turbine constructed as mentioned above, cooling steam 70, which has been extracted from a steam turbine side (not shown), is led to be supplied into the supply side steam passage 12 on the central side of the rotor end 20. The steam 70 so supplied enters the supply side steam passage 13 from the rotor end 20 to be supplied to a supply port of the moving blade 2 of second stage via the steam passage 15. While passing through the moving blade 2 and cooling it, the steam is heated to a high temperature. It then flows out into the cavity 22 via a recovery port of the moving blade 2 and the steam passage 17.

On the other hand, the steam from the supply side steam passage 13 passes through the steam passage 14 to enter the moving blade 1 of the first stage via a supply port thereof and, while cooling the moving blade 1, is heated to a high temperature. It then flows out into the cavity 22 via a recovery port of the moving blade 1 and the steam passage 16. In the cavity 22, the steam which has cooled the moving blade 1, on the one hand, and the moving blade 2, on the other hand, and has been heated to a high temperature, joins together and, flowing through the recovery side steam passages 19, 21, is recovered at the rotor end 20 as a recovery steam 71 of high temperature. This is returned to the steam turbine side for effective use thereof.

In the above-mentioned steam-cooled system, the steam flows in the moving blade for cooling thereof, the steam used for the cooling is recovered and this recovered steam is returned to the steam turbine side for effective use thereof. Especially as the moving blades 1, 2 of first and second stages have a large thermal capacity in which a steam-cooled effect is large, the moving blades 3, 4 of later stages have less thermal capacity, and hence in the present embodiment, the moving blades 1, 2 the first and second stages only are cooled. It is a matter of course, however, that all the moving blades 1 to 4 may be cooled.

According to the recovery type steam-cooled gas turbine of the first embodiment, the cooling steam 70 of low temperature and high pressure passes through the central portion of the rotor end 20 and the supply side steam passage 13 on the rotor disc 11 side to be supplied into the moving blades 1, 2 for cooling thereof, and the recovery steam which has become a high temperature low pressure steam is recovered through the recovery side steam passages 19, 21 provided on the outer side of the supply side steam passages 12, 13. Thus, the high pressure steam flows on the inner side in the rotor 10 and through the central portion of the rotor end 20 and hence there are fewer places from where the steam leaks outside as compared with the prior art where the high pressure steam has been supplied from the outer side and the leakage amount of the steam is reduced.

Figure 2:
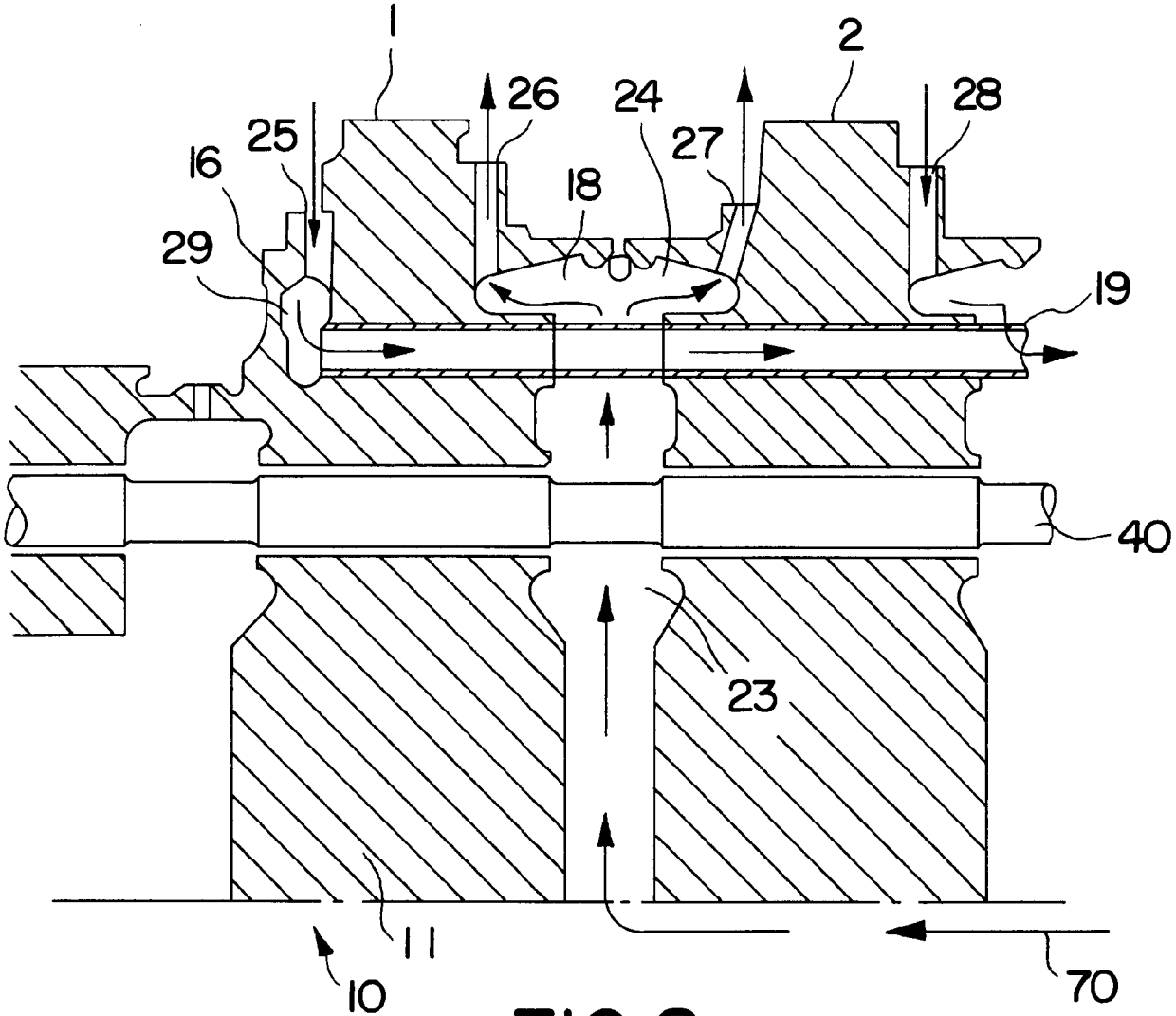
FIG. 2 is a cross sectional view of a recovery type steam-cooled gas turbine of a second embodiment according to the present invention.
Figure 3:
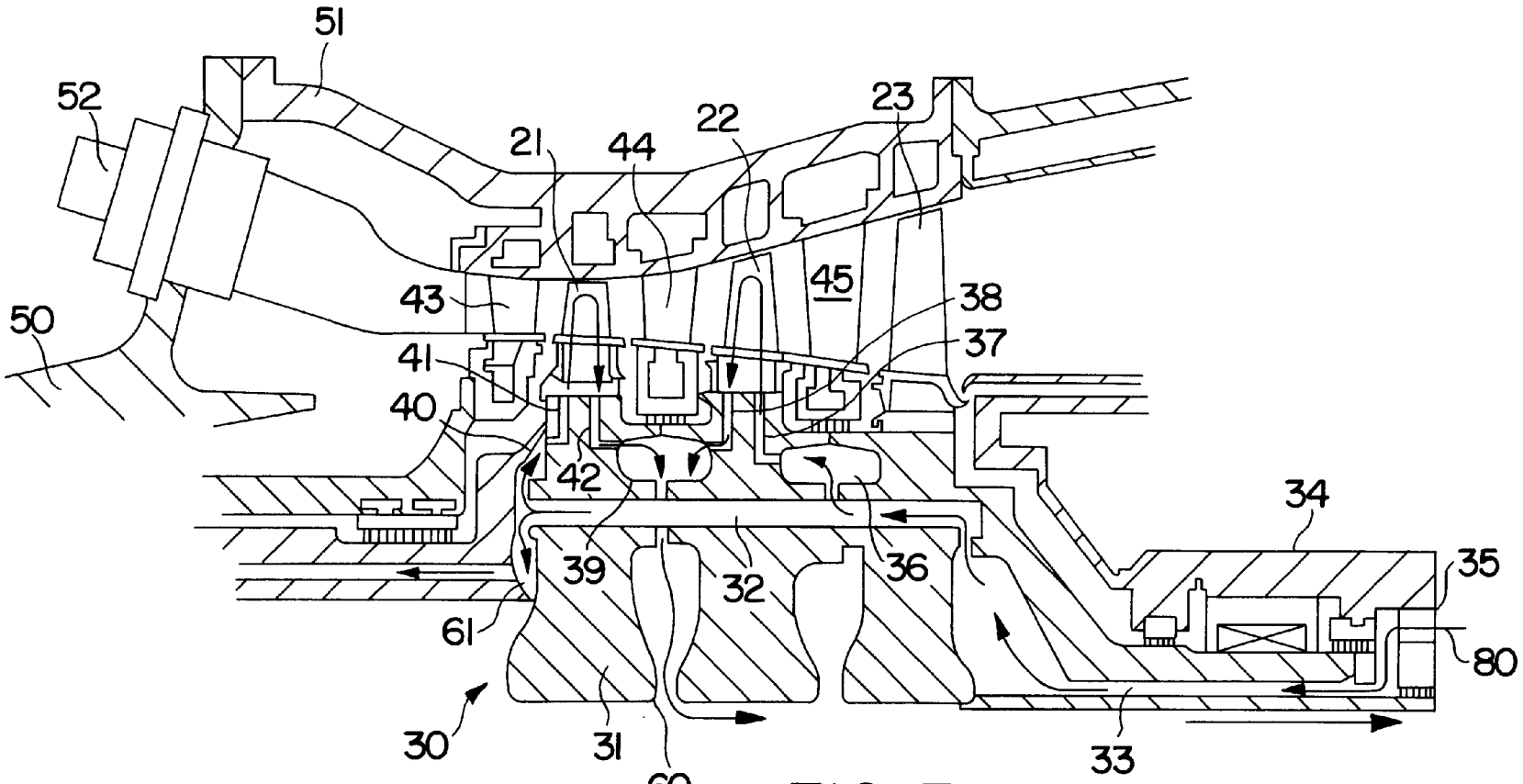
FIG. 3 PRIOR ART
FIG. 3 is a cross sectional view of a prior art recovery type steam-cooled gas turbine.

FIG. 2 is a cross sectional view of a recovery type steam-cooled gas turbine of a second embodiment according to the present invention. FIG. 2 shows rotor disc portions only of moving blades 1, 2. In FIG. 2, cooling steam 70 flows through a central portion of a rotor 10 even on a rotor disc 11 side to enter a cavity 24 via a cavity 23 and is supplied from the cavity 24 into steam passages 26, 27 of the moving blades 1, 2 of first and second stages, respectively.

The steam supplied to the moving blades 1, 2 flows in the blades via supply ports of the respective blades for cooling of the blades and flows out of recovery ports of the respective blades into steam passages 25, 28 to pass through a recovery side steam passage 19 and to be recovered at a rotor end, as in the first embodiment. It is to be noted that numeral 40 designates a disc fastening shaft.

According to the second embodiment described above, the cooling steam 70 of low temperature and high pressure passes through the central portion of the rotor 10 even on the rotor disc 11 side and is supplied therefrom into the moving blades. This corresponds, if compared with the first embodiment, to a case where the supply side steam passage 13 of the first embodiment moves further to the central portion of the rotor 10. Accordingly, there are even fewer places from where the high pressure steam leaks outside and a more secured effect can be obtained.

It is understood that the invention is not limited to the particular construction and arrangement herein illustrated and described, but embraces such modified forms thereof as come within the scope of the following claims.

What is claimed is:

1. A recovery type steam-cooled gas turbine, comprising:

a rotor comprising a plurality of rotor discs, said rotor discs having rotor disc interiors, and said rotor having a rotor axial direction and a rotor end;

moving blades mounted on said rotor discs, said moving blades having respective moving blade interiors;

at least one supply side steam passage communicating with said moving blade interiors for leading cooling steam into said moving blade interiors for cooling said moving blades, said at least one supply side steam passage extending in an axial direction through said rotor disc interiors in the rotor axial direction from said rotor end and communicating with said rotor disc interior; and a plurality of recovery side steam passages communicating with said moving blade interior for recovering the cooling steam after being used for cooling, said recovery side steam passages communicating with said rotor disc interior and extending therethrough in the axial direction;

wherein said at least one supply side steam passage is provided on a radially inner side of said plurality of recovery side steam passages; and wherein said recovery side steam passages comprise recovery pipes extending through and between said rotor discs so as to minimize the number of places from which the cooling steam can leak and said at least one supply side steam passage comprises at least one supply pipe extending through and between said rotor discs so as to minimize the number of places from which the cooling steam can leak.

2. The recovery type steam-cooled gas turbine of claim 1, wherein said at least one supply side steam passage comprises a single passage extending along a rotor axis in said rotor end.

3. The recovery type steam-cooled gas turbine of claim 1, wherein:

said moving blades comprise first stage moving blades and second stage moving blades; and said at least one supply side steam passage comprises at least one supply pipe extending along a rotor axis in said rotor end and through and between said plurality of rotor discs, and radial passages extending from said at least one supply pipe in a radial direction with respect to said rotor.

4. The recovery type steam-cooled gas turbine of claim 1, wherein said at least one supply side steam passage comprises a plurality of supply pipes extending through and between said rotor discs so as to minimize the number of places from which the cooling steam can leak.

* * * * *